US005343909A

United States Patent [19]

Goodman

[11] Patent Number: 5,343,909

[45] Date of Patent: Sep. 6, 1994

[54] LIQUID TRANSFER DEVICE

[76] Inventor: Jack Goodman, 3011 N. 3rd St., Arlington, Va. 22201

[21] Appl. No.: 81,051

[22] Filed: Jun. 25, 1993

Related U.S. Application Data

[63] Continuation-in-part of Ser. No. 990,954, Dec. 17, 1992.

[51] Int. Cl.[5] ..... B65B 3/04

[52] U.S. Cl. ..... 141/242; 73/863.32; 73/264.13; 422/100; 141/25; 141/24; 141/130; 141/114

[58] Field of Search ..... 141/235–242, 141/130, 114, 24–26, 67; 73/863.32, 864.14, 863.84, 863.91; 422/99, 100

[56] References Cited

U.S. PATENT DOCUMENTS

| | | | |
|---|---|---|---|
| 3,568,735 | 3/1971 | Lancaster | 14/238 |
| 3,572,552 | 3/1971 | Guinn . | |
| 3,807,235 | 4/1974 | Lefkovits et al. . | |
| 3,982,438 | 9/1976 | Byrd . | |
| 4,047,438 | 9/1977 | Sekine | 141/25 X |
| 4,158,035 | 6/1979 | Hasse et al. | 422/100 |
| 4,444,062 | 4/1984 | Bennett et al. | 73/863.32 |
| 4,461,328 | 7/1984 | Kenney | 141/67 |
| 4,511,534 | 4/1985 | Bennett, Jr. et al. | 422/100 |
| 4,532,805 | 8/1985 | Flesher | 73/863.32 |
| 4,537,231 | 8/1985 | Hasskamp | 141/238 |
| 4,626,509 | 12/1986 | Lyman | 73/863.32 X |
| 4,852,620 | 8/1989 | Jakubowicz et al. | 141/25 |
| 4,884,602 | 12/1989 | Yamamoto et al. | 141/242 |

*Primary Examiner*—Ernest G. Cusick
*Attorney, Agent, or Firm*—Eric P. Schellin

[57] ABSTRACT

A liquid transfer device including a holder for a pipette array. A flexible preformed membrane having cups is over the proximal openings of the pipettes and sandwiched therebetween with a housing with the cups extending into the proximal openings of the pipettes. A vacuum drawn in the housing everts the membrane from the proximal openings thereby creating reduced pressure in the pipettes which when their distal ends are immersed in a liquid will draw up some of the liquid into the pipettes in substantially equal amounts. In one embodiment a movable abutment is provided to control the upward travel of the everting membrane and thereby the amount of liquid drawn into the pipettes. A method for fabricating the preformed membrane is also shown.

2 Claims, 7 Drawing Sheets

37
-39-
57

37
17
-39-
23
25

37
-39-
19
23
25

LIQUID TRANSFER DEVICE

This is a continuation-in-part of U.S. patent application Ser. No: 07/990,954 filed: Dec. 17, 1992 entitled: LIQUID TRANSFER DEVICE.

BACKGROUND OF THE INVENTION

In many medical diagnostic tests it is often necessary to add simultaneously an exact amount of compartmentalized bodily fluids from numerous patients to an array of test tubes or cuvettes or the like. Or, conversely it is necessary to add simultaneously exact amounts of a reagent to an array of test tubes or cuvettes and the like wherein such array has been previously charged with a patient bodily fluid component. Exactitude is controllable when a single pipette is employed. However, in the need for efficiency and expeditiousness most diagnostic tests are carried-out in arrays whereby either series of different tests are performed on the same patient's bodily fluid or many patients' bodily fluids are given the same test.

In such instances it is imperative that the transfers of liquid of whatever type be accomplished with a high degree of accuracy and reproducibility.

SUMMARY OF THE INVENTION

The device of the present invention includes one or more vertically disposed pipettes or vertically disposed pipette like structures each of which extends for a substantially elongated distance. Pipettes in the present context is defined as a tube for carrying a quantity of aspirated liquid wherein the tube is open at both ends and the bottom opening is somewhat smaller than the top opening and the bottom portion of the tube tapers downwardly into a tip. Each of the pipettes terminates at its distal end at substantially the same level along a horizontal plane. Each of the respective proximal ends has a flexible inelastic preformed membrane secured about a perimeter of the proximal opening of said pipettes and the said membrane has a plurality of rounded normally downwardly extending portion detailed into a cup-like configuration which extend into the proximal open end portions of the pipettes. Each of the proximal ends of the pipettes terminate in a housing. The housing is detailed to support and carry the pipettes at their respective ends thereof. It is specifically pointed out that the proximal ends of the pipettes do not have direct access to the housing due to the fact that the preformed inelastic membrane is positioned intermediate between the said openings and a space defined in the housing. The pipettes are constructed of a polyolefin such as polyethylene or polypropylene.

The housing has an egress port to which a conduit is secured to a controlled vacuum source. As a vacuum is drawn in the space defined by the housing the preformed inelastic membrane cups evert out of the opening of the housing into the housing.

In an embodiment a vertically movable rounded plunger stop means is adjustably located above the proximal ends of the pipettes whereby the rounded portions of the plunger means comes into contact with the everting cupped membrane thereby inhibiting further upward eversion due to the presence of the plunger. The vertical positioning of the plunger thereby controls the volume that may be carried by the pipettes.

In operation, the housing carrying the plurality of pipettes is moved by suitable carriage means to a position above an open dish or reservoir containing a liquid a portion of which is to be removed and transferred.

The housing carrying the pipettes of the invention is then moved downwardly vertically to a position whereby the distal tips of the pipettes extend below the level of the liquid.

When in this position the housing is subjected to a negative or reduced pressure resulting in everting the cups of the membrane to a position whereby it lies in abutment against a corresponding respective plunger in said one embodiment. It has been found especially desirable to structure the downwardly extending plunger to describe a radius of curvature that is the same as the radius of curvature of the top portion of the everting cupped membrane from their respective open top proximal portions of the pipettes. In so doing the eversion of the membrane causes a reduction of pressure in each of the array of pipettes and therefore a quantity of liquid moves into and up into the respective pipettes to essentially to the same level resulting in identical quantities.

At this juncture the housing carrying the pipettes is raised vertically to a point whereby the distal ends or the tips of the pipettes are above the liquid and the edge of the liquid containing dish. The differential in air pressure is maintained in the housing during transfer. The openings of the tops of the pipettes are sufficiently small and the to-be-transferred liquid is sufficiently viscous so that the liquid to-be-transferred does not drain from the pipettes until desired.

The housing carrying the array of liquid loaded pipettes is moved horizontally until the tips of the pipettes are suitably aligned above individually disposed test tubes or cuvettes or other appropriate receiving receptacles. Once in that position the vacuum in the housing is removed whereby the liquid in each of the pipettes descends therefrom into a respective receptacle wherein further process steps may be initiated.

While the housing and pipette array therewith may be reused in the same fashion, if desired; the housing is designed to be disposable at the conclusion of the delivery with the replacement of a fresh set of pipettes with cupped membrane in the housing thereby avoiding contamination.

An important feature of the invention also resides in the manufacture techniques involved in fabrication of the inelastic membrane having the plurality of the cups preformed prior to affixing to the proximal openings of the array pipettes. In summary a thermoplastic membrane, such as a polyolefin such as polyethylene is thermally vacuum formed against a male mold having a plurality of spaced cups. The male mold with the formed thermoplastic membrane still attached thereto is then positioned above an array of upwardly facing pipettes and the cups are suitably aligned therewith. The male mold is then brought together with the said openings of the pipettes and the now formed cupped membrane is released. The release can be more efficacious with the drawing of a slight vacuum in the pipettes and conversely air pressure through porosity in the male mold assists to drive the preformed membrane into suitable position. As heretofore stated the cup portions of the preformed membrane extend into the proximal portion of the pipettes. The connecting portions between the cups of the membrane rests on the upwardly facing rim portions of the pipettes. As both the now positioned preformed membrane and the pipettes are constructed of polyolefins the membrane is conveniently heat sealed along said connecting portions to the upwardly facing rim portions of the pipettes. The heat sealing is accomplished by bringing a heat sealer having depending annular portions into momentary contact on that portion of the membrane overlying the rim portion of the pipettes. The membrane is very thin but the preforming and inplacing techniques herein described avoids the need for the membrane to be self-sustaining. It is pointed out that the cost for the membrane is relatively insignificant and the cost of the pipettes fabricated from polyolefin such as polyethylene is not much more enabling the user to dispose of the pipette and affixed thereto the preformed membrane after only a single use.

DETAILED DESCRIPTION OF THE DRAWINGS

Figure 1:
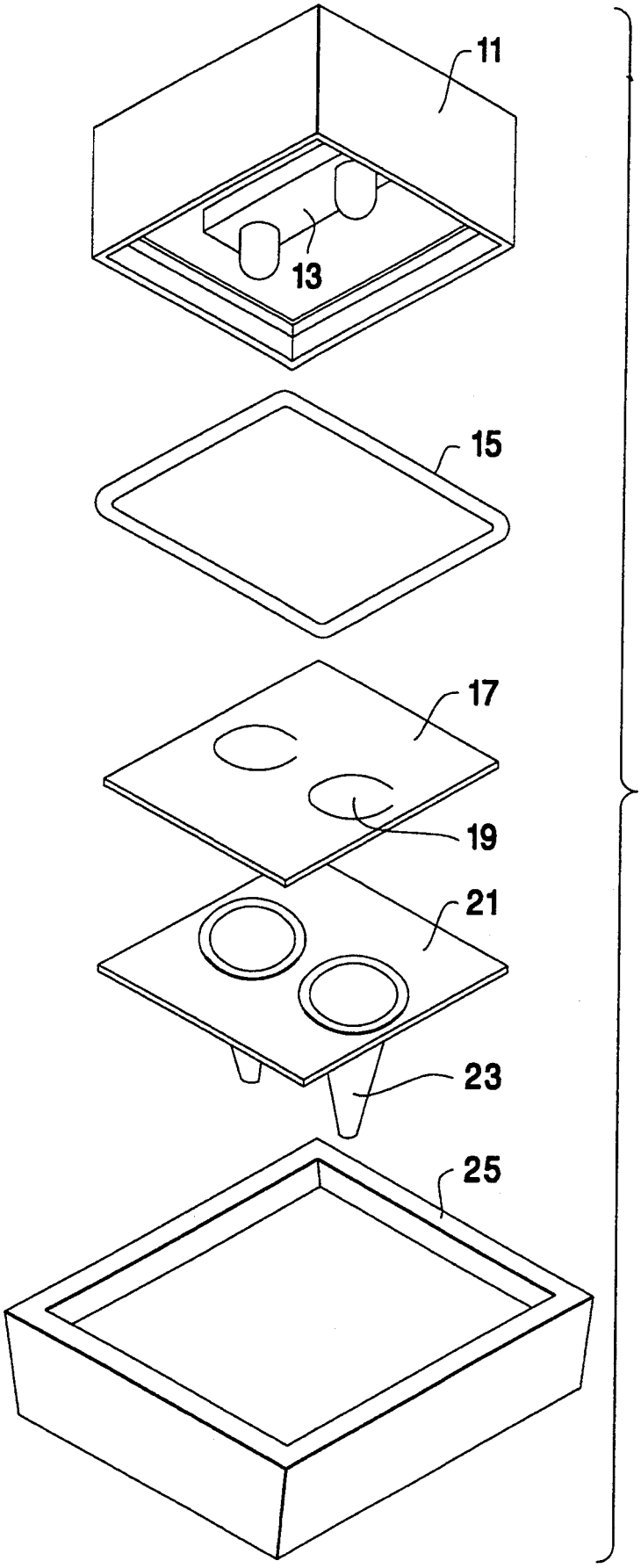
FIG. 1 is a schematic vertically exploded view of the device of the present invention with a liquid containing dish.

Attention is directed, as a first instance, to FIG. 1 from whence one can see the underside of a housing 11 with a view of the plunger 13.

A gasket 15 is suitably dimensioned and fits into the housing 11. A preformed membrane 17 having a plurality of cups fits inside the gasket 15 or can abut at the underside thereof. The membrane has concavities or cups 19, positioned to overlie and extend thereinto of the proximal openings of truncated cone pipettes 23 secured to a carrier 21.

The array shown thus far is assemblied as a unit and is then vertically thrust into a liquid containing dish 25 carrying the to-be-transferred liquid.

It will be appreciated that the structure depicted is schematic and that only two liquid transfer pipettes are shown. It may be found useful to employ only a single liquid transfer pipette. On the other hand more than the two liquid transfer pipettes depicted will likely be used. Usually, a considerable number of diagnostic tests will be carried out, for instance, on a single blood serum sample from a single patient. Therefore, a number of receptacles will have to be simultaneously charged. Each receptacle may already contain a specific reagent or appropriate reagents may be subsequently added to the receptacle as desired and/or necessary.

Figure 2:
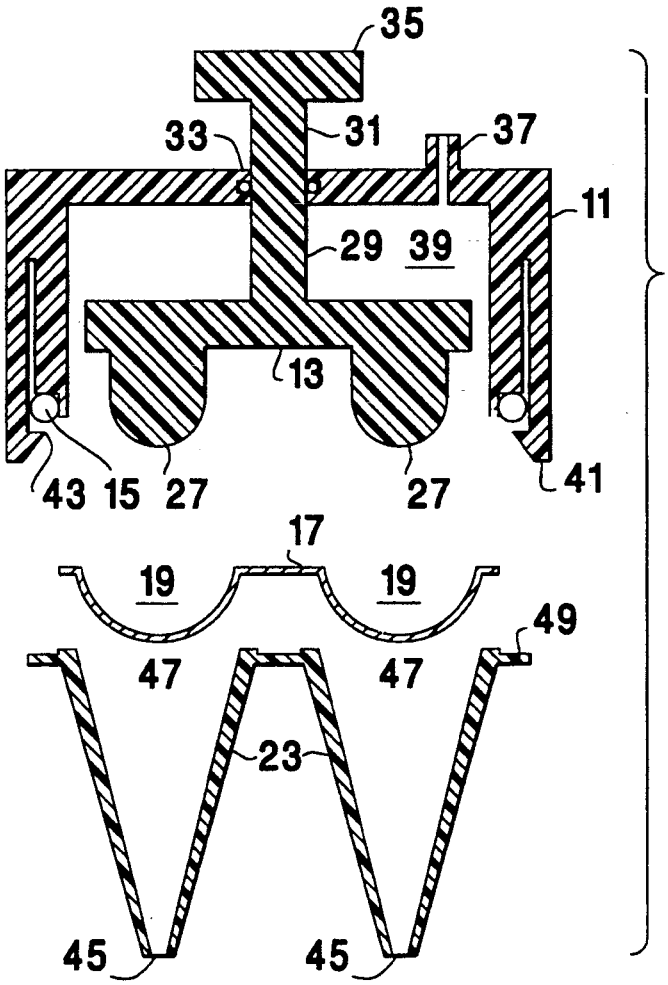
FIG. 2 is a schematic exploded cross-sectional view of one embodiment of the device.

Returning, now, to a further consideration of the drawings, attention is now directed to FIG. 2 which is also an exploded view but is in cross section. Note therefrom housing 11. The housing 11 carries a plunger 13 terminating in bulbous portions 27. The plunger has a stem 29. It extends through an opening 31 of the housing 11 and moves vertically up or down. It is sealed with an O-ring 33. The plunger terminates with a finger handle 35 at the top.

The housing has a tubular stub 37 to which a conduit (not shown) is attached for securing a vacuum or pressurization as needed internally of the space 39 of the housing 11.

The housing 11 is supplied with flexible ring-like portions 41 which are spaced from the housing 11 and which terminate with inward extending shoulders 43.

Therein below are mounted the truncated cone pipettes 23 each with a small orifice 45 at their respective distal end and a considerably wider mouth 47 at each of its respective proximal ends. The preformed membrane 17 is detailed to fit therein over and is sandwiched between the gasket 15 and a horizontally extending flange 49 of the pipette 23. The shoulder 43 of the ring-like portions 41 are designed to fit under the flange 49 to thereby secure together the housing, preformed cupped membrane and pipettes.

Figure 3:
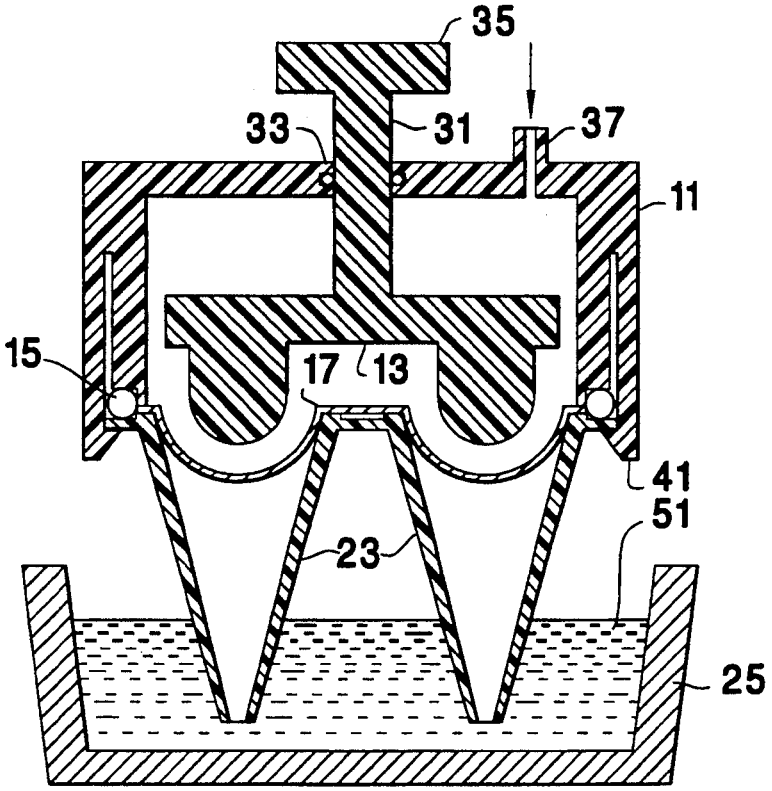
FIG. 3 is a schematic cross-sectional view of the embodiment of FIG. 2 device prior to being loaded.

FIG. 3 shows the same components in an assembled manner. Note also that the said assembled device is immersed in a liquid 51 in the dish 25.

The said device has been brought into the depicted position of, for instance, FIG. 3 by a suitable conventional carriage means (not shown) which moves the said device in both a vertical manner and a horizontal sweep as necessary.

In FIG. 3 no liquid has entered the pipettes because of the ambient air in the pipette which prevents ingress of liquid.

Figure 4:
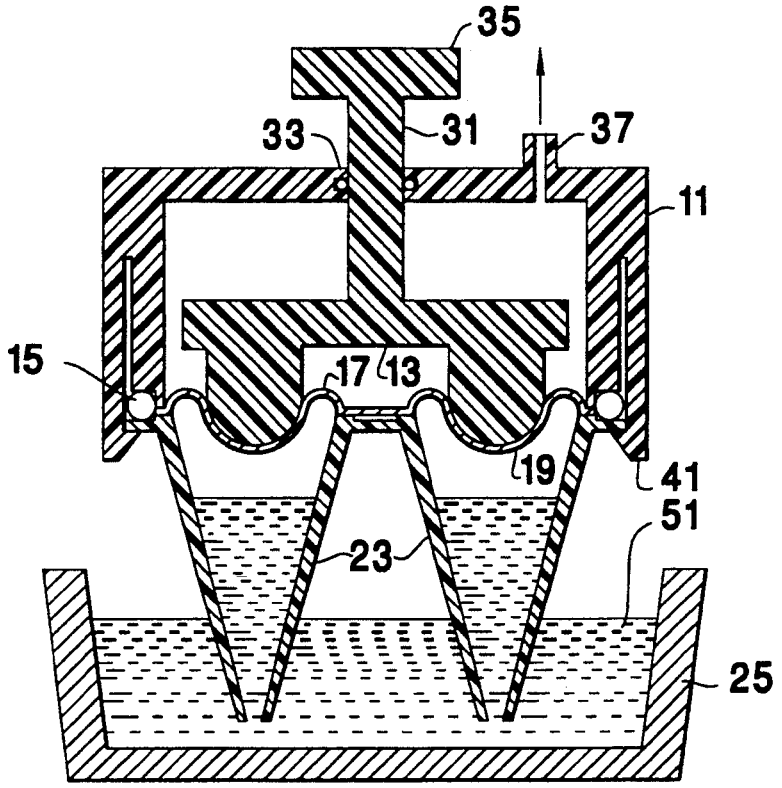
FIG. 4 is a schematic cross-sectional view of the embodiment of FIG. 2 device being loaded.

Then in FIG. 4 one can see the influence of drawing a slight vacuum on the space 39 of the housing 11. It will be seen that due to the flexibility of the preformed cupped membrane 17 and presence of a slight vacuum the membrane has been drawn upwardly to have its concavity or cup portions 19 to lie against the bulbous portions 27 of the plunger. It will also be appreciated, as the membrane everts upwardly in response to the slight vacuum in the housing, a small vacuum is likewise drawn in the interior of the pipettes which, as a result, draws in a quantity of the liquid 51.

Once the pipettes are loaded the housing and the pipettes carried thereby is withdrawn from the dish and is transferred by suitable means (not shown) whereby it is positioned above receiving receptacles 57 which may be individual test tubes in a rack or may be a part of a multi-titer array.

Figure 5:
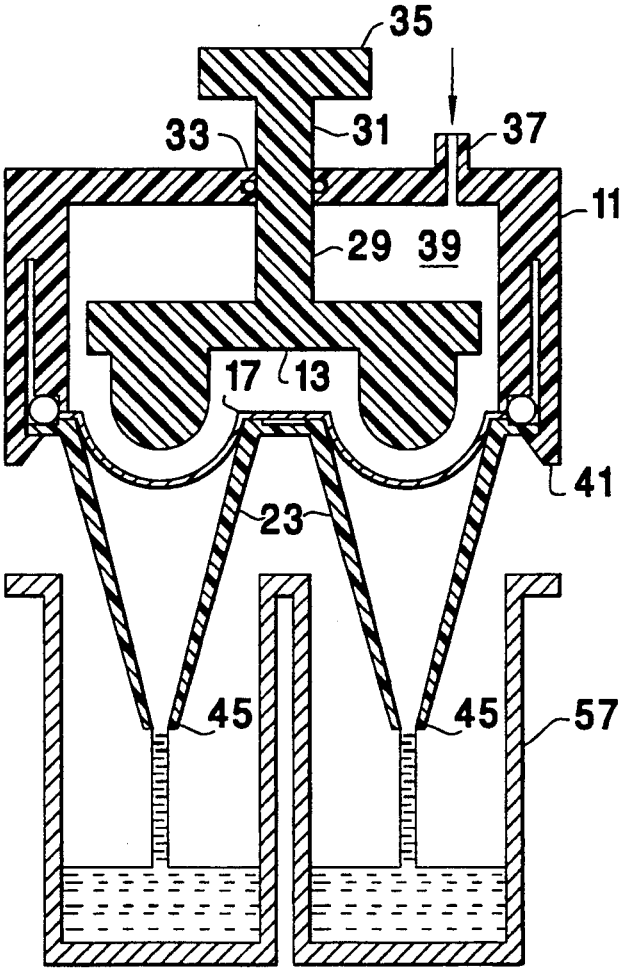
FIG. 5 is a schematic cross-sectional view of the embodiment of FIG. 2 device being unloaded.

In FIG. 5 one can see the device of the present invention positioned whereby each pipette extends with its distal end into an individual test tube or the like. The liquid is unloaded thereinto by subjecting, the space 39 of the housing 11 to an increase in gaseous pressure whereby the cups of the membrane 17 is moved away from the plunger 13 to drive the liquid out of respective orifices 45 into the test tubes 57 and membrane regains its cup-like configurations.

Figure 6:
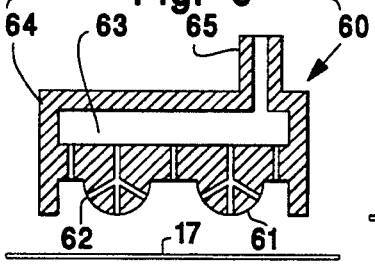
FIG. 6 is a schematic cross-sectional view of a male mold in a first step in the formation of a preformed cupped membrane.
Figure 7:
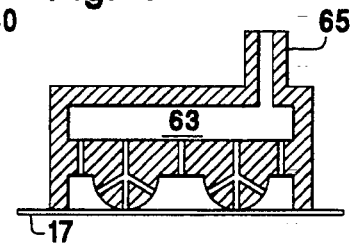
FIG. 7 is in the same view showing a second step.
Figure 8:
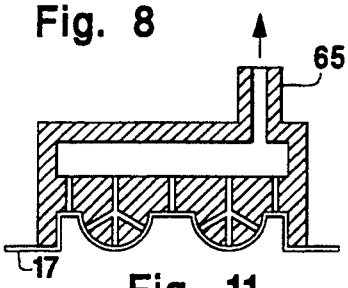
FIG. 8 is the same view showing a third step.
Figure 9:
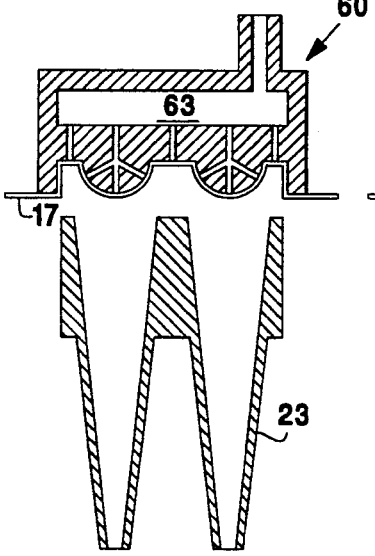
FIG. 9 is the same view showing a fourth step with a schematic cross-sectional positioning of pipettes.
Figure 10:
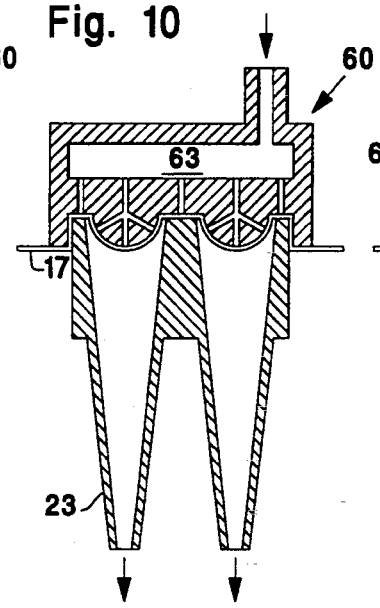
FIG. 10 is the same view as FIG. 9 showing the next step.
Figure 11:
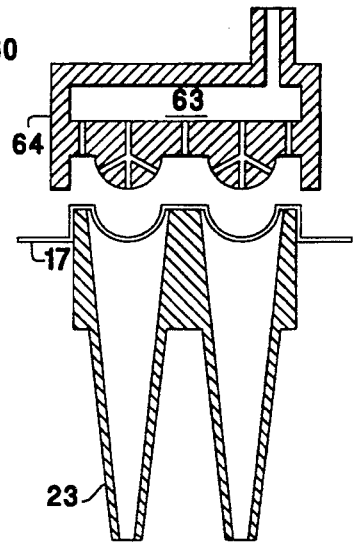
FIG. 11 is the same view as FIG. 10 showing the subsequent step.
Figure 12:
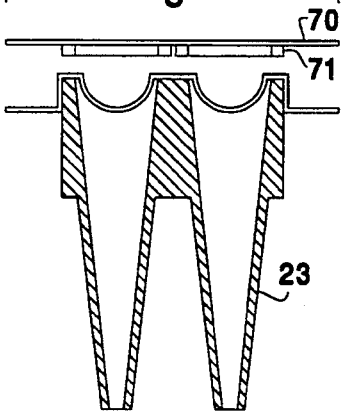
FIG. 12 is a schematic cross-sectional view of the preformed cupped membrane and pipettes about to be heat sealed together.
Figure 13:
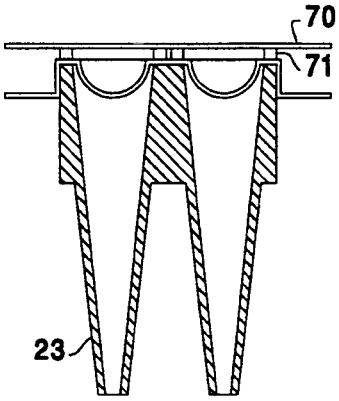
FIG. 13 is like FIG. 12 but shows heat sealing of the preformed membrane onto the pipettes.
Figure 14:
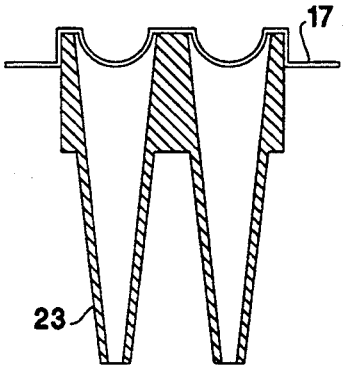
FIG. 14 is the schematic cross-sectional view of the pipettes fitted with the preformed cupped membrane.

FIGS. 6 to 14, in seriatum, depict the ingenious manner in which the membrane having the plurality of cups is fabricated and then affixed to the upwardly facing rim portions of the pipettes. In FIG. 6 a male mold 60 is provided which has rounded protrusions 61. The mold 60 has a series of bores 62 which communicate with a space 63 in a housing portion 64 of the mold 60. The bores 62 are not necessary if the said protrusions 61 are porous. The housing portion 64 has a conduit connector 65 for alternately drawing a vacuum or providing pressure as necessary. A planar membrane 17 is brought into abutment with the mold 60 as seen in FIG. 7. The environment of the membrane 17 and mold 60 are heated to assist in the thermovacuuming techniques. FIG. 8 depicts the membrane 17 in convoluted contact with the surface of the mold as a vacuum is drawn in space 63 and the cup have thereby been formed. In FIG. 9, an array of pipettes 23 is brought into alignment with the formed membrane 17. In FIG. 10 the pipettes 23 have been brought into a position whereby the flat surfaces of the formed membrane is sandwiched between the rim edge portions of the proximal ends of the pipettes 23. The formed membrane 17 is deposited thereupon by pressurizing the space 63 of the mold to thereby release the formed membrane 17. FIG. 11 shows the mold 60 being withdrawn leaving the formed membrane 17 on the pipettes but not yet in an adhered position. Then, in FIG. 12 the pipettes with the formed membrane carried thereon are brought into alignment with a heat sealer having depending rings 71. In FIG. 13 the heat sealer 70 is brought into momentary abutment with the flat land areas of the formed membrane on the rims of the pipettes whereby such land areas are sealed to said rims. It will be seen thereby that adhesives are avoided. In FIG. 14 one can see, the finished product with the formed membrane having the cups, is securely affixed to the rims of the pipettes 23.

As was emphasized in the above the membrane 17 is inelastic yet during its fabrication into a form having cups it most undergo a certain degree of deformation during the vacuum forming step during which heat to the membrane is supplied, as necessary, to enhance the deformation. The enlarged view of the vacuum formed membrane reveals that the membrane 17 has been deformed whereby it is somewhat thinner at the confluence 73 between the edges of the formed cups and the flat land portion of the membrane. Such thinner confluences provide the desired flexibility so that as the cups undergo eversion, the thinner portions of the said confluences act as hinges.

Figure 21:
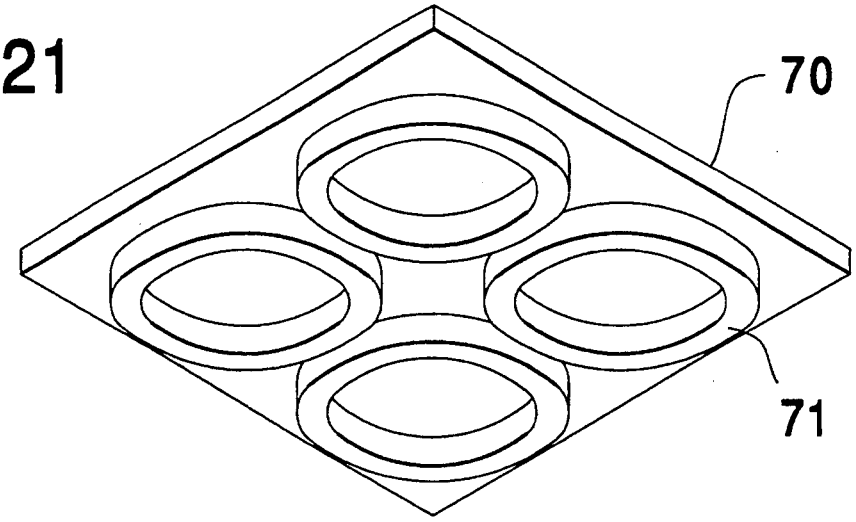
FIG. 21 is a schematic perspective of the underside of the heat sealer.

FIG. 21 more clearly shows the underside of the heat sealer 70 with the heat delivering inpingement rings 71.

Figures 15, 16, 17:
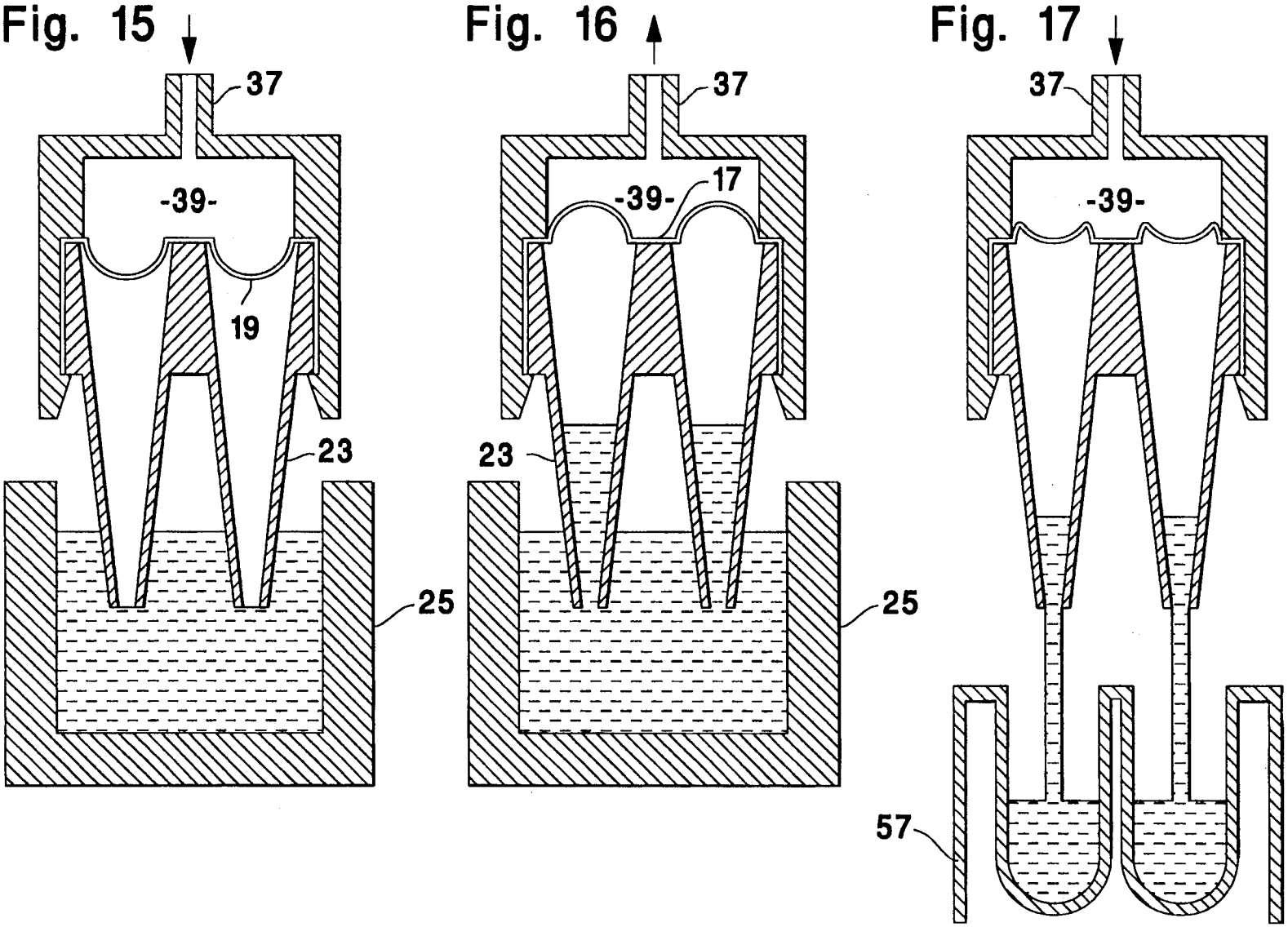
FIG. 15 is a schematic cross-sectional view of the first step of liquid transfer with a housing of a second embodiment.
FIG. 16 is like FIG. 15 with uptake of to-be-transferred liquid.
FIG. 17 is schematic cross-sectional view of the embodiment of FIG. 15 showing dispensing of the liquid.

As in the FIGS. 3, 4 and 5 embodiment, FIGS. 15, 16 and 17 show the positioning of the tips of the pipettes in a liquid in a dish, a vacuum above the preformed membrane thereby everting the cups and then delivering the liquid from the pipettes as the cups are driven into a normal position by pressurization in the space and on the membrane on the side opposite to that of the distal liquid carrying pipettes.

Figure 19:
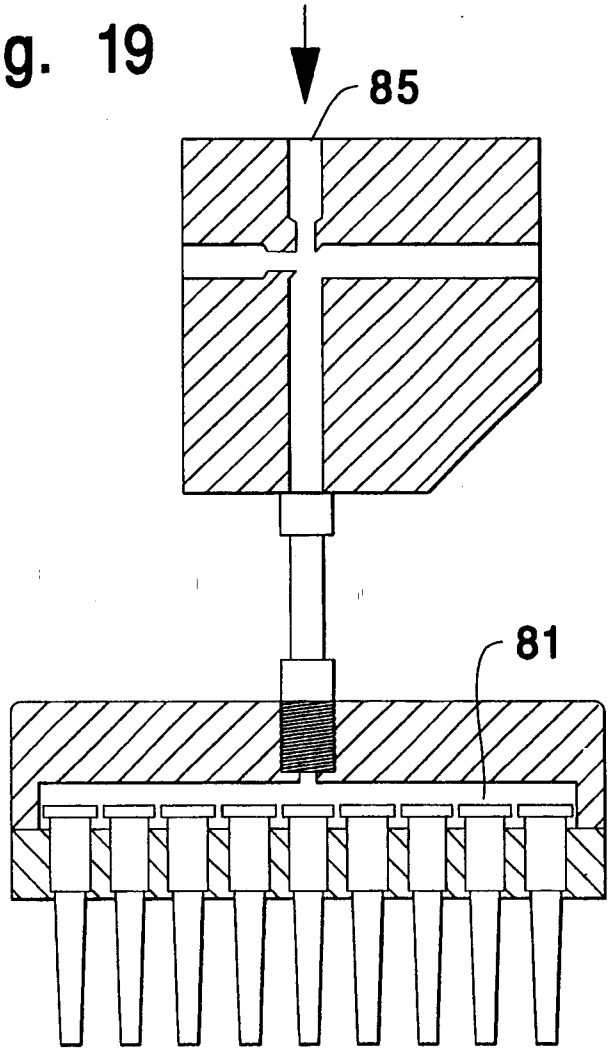
FIG. 19 is similar to FIG. 18 showing gas pressurization to dispense the liquid from the pipettes.
Figure 18:
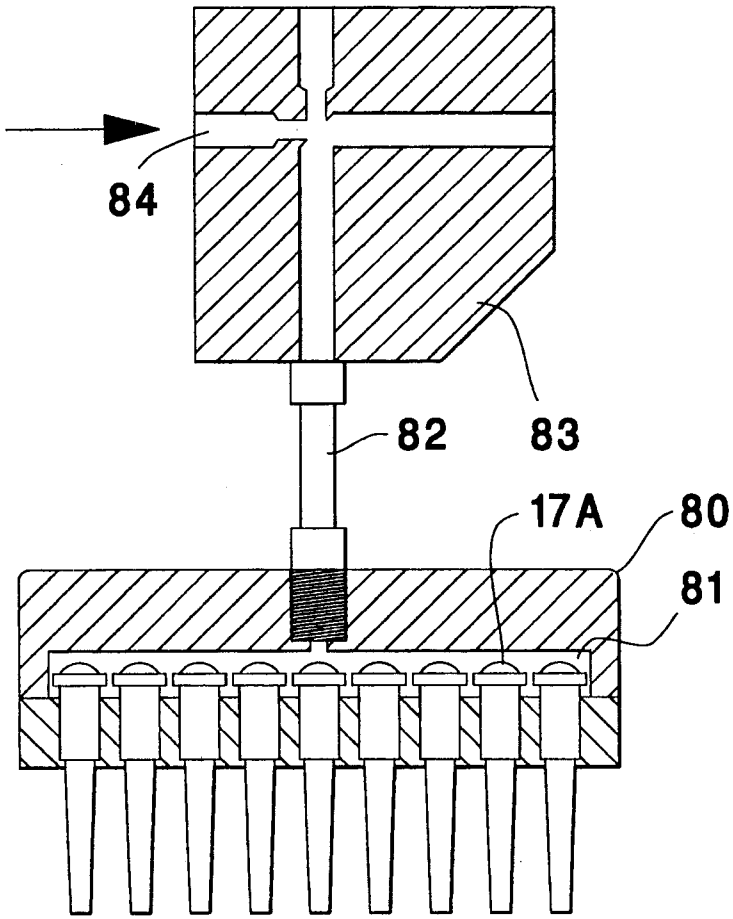
FIG. 18 is a partial cross-sectional view showing the drawing of a vacuum through a gas driven venturi.
Figure 20:
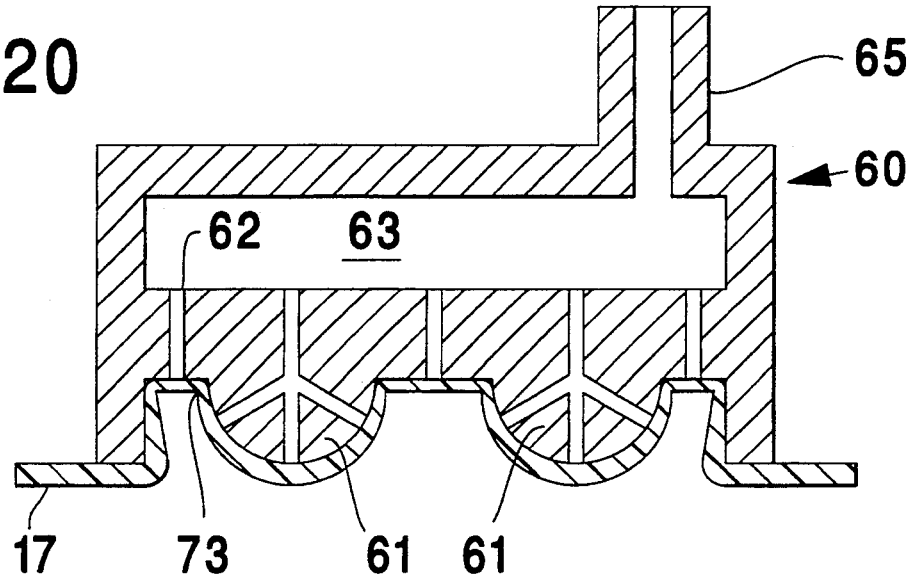
FIG. 20 is a schematic cross-sectional more clearly showing the varying thickness of the preformed membrane.

FIGS. 18 and 19 show in schematic form a linear array of pipettes in a housing 80 having a space 81 which is subjected to pressure reduction by means of a conduit 82 which is connected to a venturi device 83. A vacuum is drawn in space 81 when gas under pressure enters the venturi device 83 through port 84. The decrease in pressure in space 81 results in the eversion of the cups 17A of membrane 17 as depicted.

The opposite occurs when gaseous pressure from a source enters through port 85 thereby pressurizing space 81 and thereby driving cups 17A back into the proximal portion of the pipettes.

It will be appreciated that in the first position, had the tip portions of the pipettes been in a liquid some of the liquid would have drawn into the pipettes and in the second position the liquid would have been driven from the pipettes all as previously discussed in the above.

The use of the preformed inelastic membrane avoids the necessity of employing an elastic membrane of the prior art which must be stretched to temporarily deform to draw in liquid into an array of pipettes. It is known that the stretching in an elastic membrane will be non-uniform thereby resulting in a non-uniform loading of the pipettes. Also resulting in a non-uniform loading is the fact that an elastic membrane is somewhat porous which porosity is exacerbated when the membrane is stretched.

The concavities of the cups are preformed to a hemisphere configuration that has one-half the volume to be dispensed. Since the membrane and the concomitant cups are flexible but not elastic they always displace the same volume regardless of variations of pressure or vacuum. As shown in the above the membrane and pipettes are heat sealed together and are inexpensive enough to be disposable.

The invention should not be limited by the claims disclosed embodiments but should be solemnly limited by the claims that follow.

What is claimed is:

1. A liquid transfer device comprising a housing, said housing having an enclosing top and sides, said housing being open at the bottom, a flexible thin inelastic membrane covering said bottom, said housing defining a space, fluid pressure changing means in operable communication with said space in said housing for reducing or increasing the fluid pressure in said space, said thin inelastic membrane having a plurality of blister-like projections arranged in rows lengthwise and crosswise thereon with relatively small planar web areas of said thin inelastic membrane between each of said blister-like projections, a lower carrier means positioned under said flexible thin inelastic membrane, said lower carrier being mounted with a plurality of pipettes perpendicular to said thin inelastic membrane, each of said pipettes terminating in an open proximal end, having a rim each of which is respectively aligned with an individual blister-like projection, said rims of said pipettes being affixed to portions of said small planar web areas, said blister-like projection extending into said proximal end of said pipette when said space of said housing is under a first fluid pressure gradient and said blister-like projection is everted from said proximal end of said pipette when said fluid pressure gradient is reduced.

2. The device of claim 1 wherein thin inelastic membrane of said blister-like projections diminishes in thickness from the apex of the blister-like projection towards the small planar web areas whereby the blister-like projections has a snap action when it moves from its extending into said proximal end of said pipette to its everted position and vice versa.

* * * * *